US012704309B2

(12) United States Patent
Park et al.

(10) Patent No.: US 12,704,309 B2
(45) Date of Patent: Aug. 11, 2026

(54) REFRIGERATOR

(71) Applicant: LG ELECTRONICS INC., Seoul (KR)

(72) Inventors: Hyunjin Park, Seoul (KR); Seongjun Yun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 218 days.

(21) Appl. No.: 18/369,515

(22) Filed: Sep. 18, 2023

(65) Prior Publication Data

US 2024/0133611 A1 Apr. 25, 2024
US 2024/0230205 A9 Jul. 11, 2024

(30) Foreign Application Priority Data

Oct. 25, 2022 (KR) ..... 10-2022-0138191

(51) Int. Cl.
*F25D 17/06* (2006.01)
*F25C 1/04* (2018.01)
*F25D 11/02* (2006.01)

(52) U.S. Cl.
CPC ..... *F25D 17/067* (2013.01); *F25C 1/04* (2013.01); *F25D 11/02* (2013.01)

(58) Field of Classification Search
CPC ..... F25D 17/067; F25D 11/02; F25D 2317/0666; F25D 2317/067; F25D 2323/021; F25D 2400/04; F25D 2400/06; F25D 2400/16; F25D 17/065; F25D 17/045; F25D 17/08; F25D 21/04; F25D 2201/10; F25D 2317/0661; F25C 1/04
See application file for complete search history.

(56) References Cited

U.S. PATENT DOCUMENTS 3,411,312 A * 11/1968 Sigl et al. ..... F25D 17/065 62/180
2012/0011879 A1* 1/2012 Gu ..... F25D 17/04 62/408
2020/0284493 A1* 9/2020 Lee et al. ..... F25D 11/02
2024/0068730 A1* 2/2024 Long et al. ..... F25C 1/04

FOREIGN PATENT DOCUMENTS

CN 108955037 A 12/2018
EP 3 705 818 A1 9/2020
JP 2008045817 A * 2/2008 ..... F25D 2317/061
KR 2003-0065772 A 8/2003
WO WO2020/173383 A1 9/2020

OTHER PUBLICATIONS

JP 2008045817 A Translation (Year: 2008).*
Extended European Search Report for European Application No. 23196014.7, dated Feb. 6, 2024.

* cited by examiner

*Primary Examiner* — Jerry-Daryl Fletcher
*Assistant Examiner* — Dario Antonio Deleon
(74) *Attorney, Agent, or Firm* — Birch, Stewart, Kolasch & Birch, LLP

(57) ABSTRACT

A refrigerator includes a grille fan assembly, which includes one evaporator and one blower fan to blow cold air generated from the evaporator, disposed in one storage chamber. The grille fan assembly supplies the cold air blown by the blower fan to a first upper storage chamber and a first lower storage chamber, thereby cooling the three independent storage chambers using one evaporator and one blower fan.

13 Claims, 14 Drawing Sheets

REFRIGERATOR

CROSS-REFERENCE TO RELATED APPLICATION

This application claims priority to and the benefit of Korean Patent Application No. 10-2022-0138191, filed on Oct. 25, 2022, the disclosure of which is incorporated herein by reference in its entirety.

BACKGROUND

Technical Field

The present disclosure relates to a refrigerator, more particularly, a refrigerator that may chill a plurality of storage chambers, using one evaporator and one blower fan.

Description of Related Art

A refrigerator is a home appliance configured to supply cold air generated by refrigerant circulation to a storage compartment (e.g., a refrigerator compartment or a freezer compartment) to keep various kinds of storage targets fresh for a long time in the storage compartment.

The cold air supplied to the refrigerator may be created by taking heat from the inside of the refrigerator, while a liquid refrigerant is vaporized into a gaseous refrigerant after the refrigerant configured to circulate in the order of a compressor, a condenser, an evaporator and a compressor flows into the evaporator.

The cold air created while passing through the evaporator may be supplied to a storage compartment by a grille fan assembly including a cold air path through which the cold air flows, and a blower fan for blowing the cold air to the storage compartment.

For example, in the present disclosure, it is referred to as a cold air system that the grille fan assembly supplies cold air to the storage compartment, but the present disclosure is not limited thereto. Additional cold air supply-related components may be provided in the cold air supply, in addition to the evaporator and the frill fan assembly.

The storage compartment may be used for various purposes such as a refrigerator compartment or a freezer compartment.

The refrigerator compartment refrigerates a storage target and the freezer compartment freezes a storage target. Due to this structure, the amount of cold air supplied to the refrigerator compartment and the freezer compartment needs to be adjusted differently so that different temperatures may be maintained.

Accordingly, the refrigerator may include a plurality of storage compartments independent of each other in order to secure a plurality of storage spaces.

In case the refrigerator includes a plurality of storage compartments having independent storage spaces, respectively, cold air may be supplied to each of the storage compartments by various cold air supply systems.

As one example, when the refrigerator includes a main storage compartment and a sub-storage compartment which are independent storage spaces, separate grille fan assemblies and evaporators may be disposed in the main storage compartment and the sub storage compartment, respectively.

Accordingly, the main storage compartment and the sub storage compartment may be independently chilled by a cold air supply system independent from each other.

However, if the main storage compartment and the sub storage compartment are chilled by separate cold air supply systems, respectively, there might be problems in that power consumption, noise and component costs increase as well as a decrease in internal volume of the sub-storage compartment.

As another embodiment, when the refrigerator includes the main storage compartment and the sub storage compartment which are independent storage spaces, the grille fan assembly and the evaporator may be disposed only in the main storage compartment and a connection duct may be formed between the main storage compartment and the sub storage compartment.

Accordingly, the cold air generated by the cold air supply system of the main storage compartment may be supplied to the sub storage compartment through the connection duct, thereby cooling the main storage compartment and the sub storage compartment by using one cold air supply system.

At this time, the sub storage compartment may be provided in plural.

In this case, a first sub storage compartment and a second sub storage compartment, which are provided as separate independent storage spaces, may be connected with the main storage compartment by separate connection ducts, respectively.

In addition, a blower fan is added to the grille fan assembly provided in the cold air supply system to form a plurality of blower fans so that cold air can be uniformly supplied even to the plurality of sub storage compartments.

Accordingly, the cold air generated by the cold air supply system of the main storage compartment can be supplied to a first sub storage compartment and a second storage compartment through their respective connection ducts, so two sub storage compartments as well as the main storage compartment may be additionally cooled by one cold air supply system.

However, when the cold air supply system of the main storage compartment includes the plurality of blower fans, there might be problems in that power consumption, noise and components costs increases as well as an internal volume of the main storage compartment decreases.

In addition, since the first sub storage compartment and the second sub storage compartment are connected with the main storage compartment by separate respective connection ducts, component costs for providing the plurality of connection ducts could increase and position dispersion occurring in an assembly process of each component might increase.

Accordingly, there is a need to develop a refrigerator that can efficiently and evenly cool the two sub storage compartments by the cold air supply system of the main storage compartment, while reducing the above problems.

SUMMARY

One objective of the present disclosure is to provide a refrigerator that may chill three independent storage compartments by using one evaporator and one blower fan.

Another objective of the present disclosure is to provide a refrigerator that may reduce power consumption, noise and component costs.

A further objective of the present disclosure is to provide a refrigerator having an efficient arrangement structure of a cold air collecting duct and a cold air supply duct that may supply and collect cold air to and from three independent storage compartments.

A still further objective of the present disclosure is to provide a refrigerator that may reduce occurrence of icing between a cold air collecting duct and a cold air supply duct, which are arranged to cross each other.

Aspects according to the present disclosure are not limited to the above ones, and other aspects and advantages that are not mentioned above can be clearly understood from the following description and can be more clearly understood from the embodiments set forth herein. Additionally, the aspects and advantages in the present disclosure can be realized via means and combinations thereof that are described in the appended claims.

To overcome the above-noted disadvantages, a refrigerator according to an embodiment is characterized in that cold air blown from one storage chamber is supplied to two different independent storage chambers.

Specifically, a grille fan assembly including one evaporator and one blower fan blowing cold air generated from the evaporator may be disposed in one storage chamber, and the cold air blown by the blower fan may be supplied to a first upper storage chamber and a first lower storage chamber.

The refrigerator may include a storage case including a first storage chamber and a second storage chamber; and a grille fan assembly disposed in the second storage chamber and comprising an evaporator; and a blower fan configured to blow cold air generated from the evaporator. Cold air blown by the blower fan may be supplied to the first upper storage chamber and the first lower storage chamber.

To solve the above-noted problems, a refrigerator according to an embodiment of the present disclosure is characterized in including a cold air supply duct that is in fluid communication with three independent storage chambers.

Specifically, the refrigerator may supply cold air to two independent storage chambers through a cold air supply duct including a cold air inlet in fluid communication with one storage chamber; and a first upper cold air outlet and a first lower cold air outlet that are in fluid communication with two different independent storage chambers, respectively.

The refrigerator may include a storage case including a first upper storage chamber, a first lower storage chamber and a second storage chamber; and a cold air supply duct including a cold air inlet in fluid communication with the second storage chamber, a first upper cold air outlet in fluid communication with the first upper storage chamber and a first lower cold air outlet in fluid communication with the first lower storage chamber.

In another embodiment of the present disclosure, a first upper cold air collecting duct collecting cold air of a first upper storage chamber in the second storage chamber may be disposed to cross a cold air supply duct.

In a further embodiment of the present disclosure, a heating unit may be disposed on one surface of the first upper cold air collecting duct facing the cold air supply duct.

In a still further embodiment of the present disclosure, an insulation material may be disposed between the first upper cold air collecting duct and the cold air supply duct. The insulation material may be disposed in a crossing area between the first upper cold air collecting duct and the cold air supply duct.

According to the embodiments of the present disclosure, a grille fan assembly including one evaporator and one blower fan blowing cold air generated from the evaporator may be disposed in one storage chamber, and the cold air blown by the blower fan may be supplied to a first upper storage chamber and a first lower storage chamber, thereby cooling the three independent storage chambers by using one evaporator and one blower fan.

In addition, since the refrigerator according to the present disclosure may cool the three independent storage chambers only through one evaporator and one blower fan disposed in one storage chamber, the power consumption and noise, which might occur due to the addition of the evaporator and the blower fan may be reduced.

In addition, the refrigerator may have the efficient arrangement structure in that the first upper cold air collecting duct collecting cold air of the first upper storage chamber to the second storage chamber and the cold air supply duct are disposed to cross each other, thereby increasing space utilization in a narrow space.

In addition, in the refrigerator according to the embodiments of the present disclosure, at least one of the heating unit and the insulation material may be disposed between the cold air supply duct and the cold air collecting duct crossing each other, thereby reducing icing phenomenon caused by wet steam that might occur in the crossing area between the cold air duct and the cold air collecting duct where cold air with different temperatures flows.

Specific effects are described along with the above-described effects in the section of Detailed Description.

DETAILED DESCRIPTION

Figure 1:
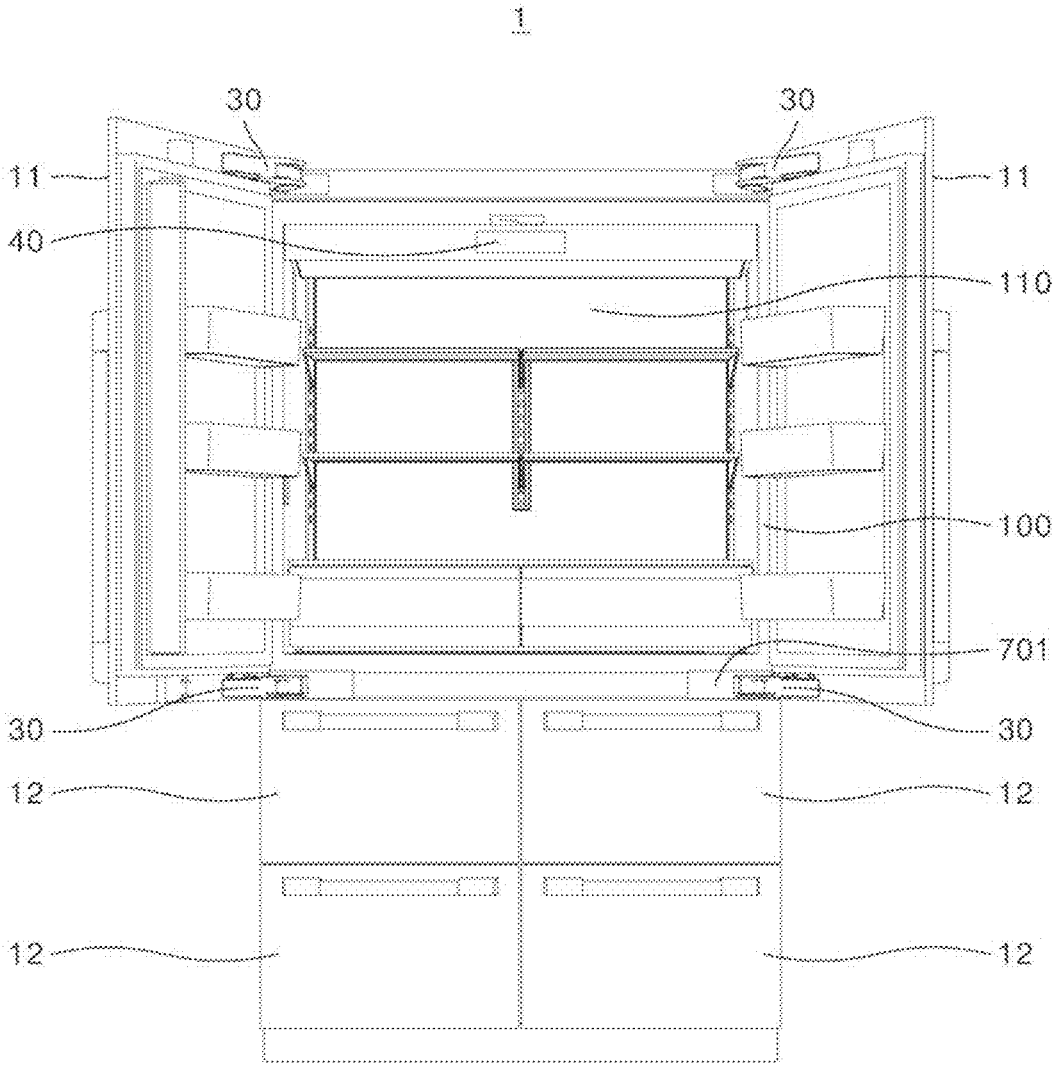
FIG. 1 is a front view of a refrigerator in which a first door is open.

The above-described aspects, features and advantages are specifically described hereunder with reference to the accompanying drawings such that one having ordinary skill in the art to which the present disclosure pertains can easily implement the technical spirit of the disclosure. In the disclosure, detailed descriptions of known technologies in relation to the disclosure are omitted if they are deemed to make the gist of the disclosure unnecessarily vague. Below, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

Throughout the disclosure, each component can be provided as a single one or a plurality of ones, unless explicitly stated to the contrary.

Hereinafter, expressions of 'a component is provided or disposed in an upper or lower portion' may mean that the component is provided or disposed in contact with an upper surface or a lower surface. The present disclosure is not intended to limit that other elements are provided between the components and on the component or beneath the component.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Throughout the disclosure, the terms "A and/or B" as used herein can denote A, B or A and B, and the terms "C to D" can denote C or greater and D or less, unless stated to the contrary.

Hereinafter, a refrigerator according to several embodiments will be described.

Figure 2:
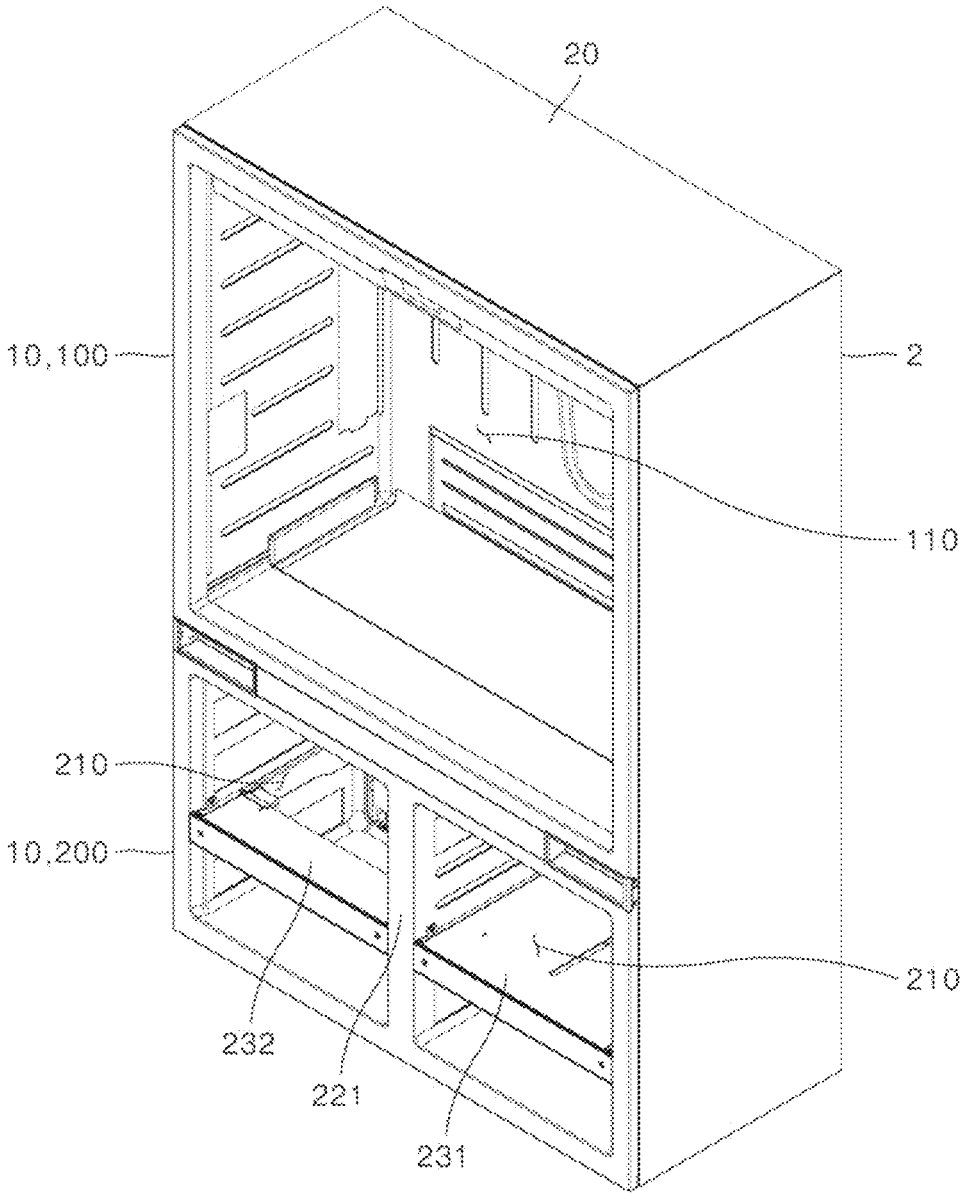
FIG. 2 is a front perspective view of a refrigerator in which a first door and a second door are removed.
Figure 3:
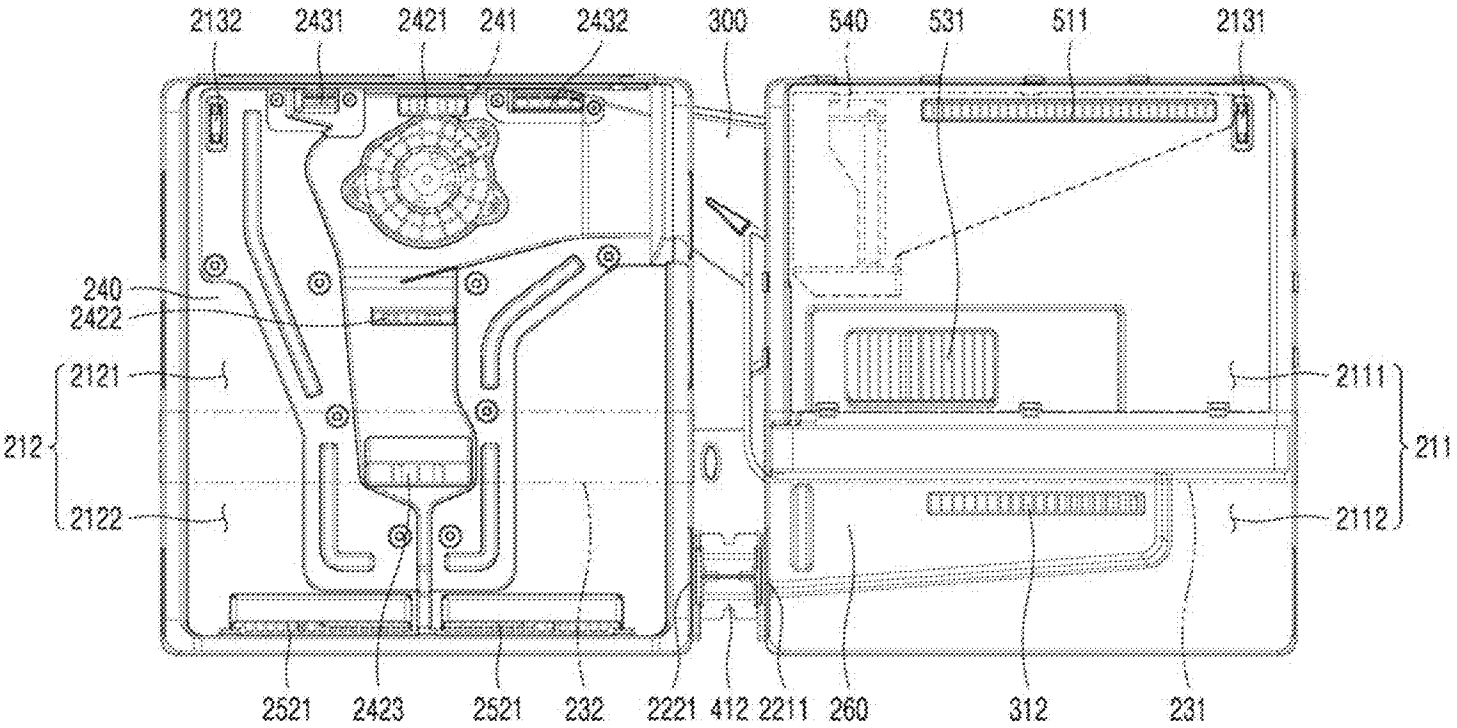
FIG. 3 is a front view of a first storage compartment and a second compartment.
Figure 4:
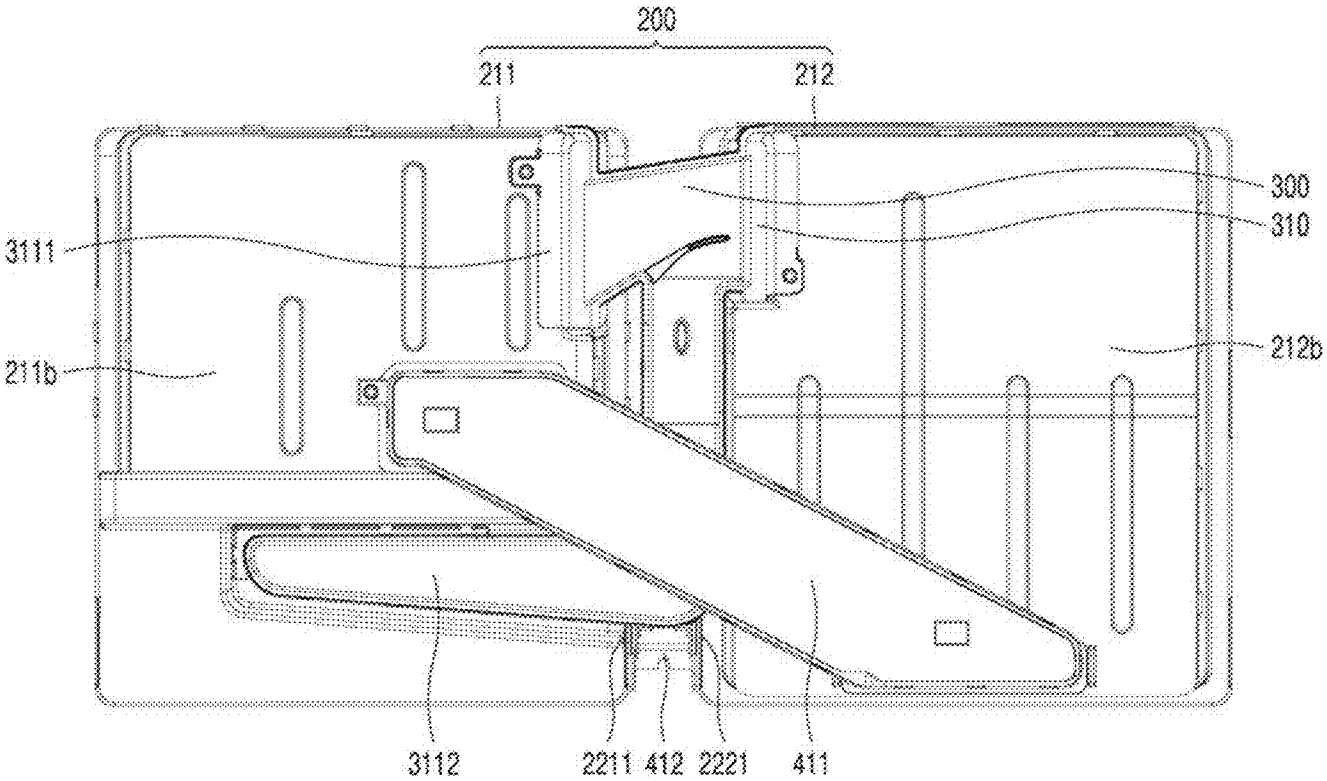
FIG. 4 is a rear view showing a cold air supply duct and a cold air collecting duct that connect a first storage compartment and a second storage compartment with each other.

Referring to FIGS. 1 and 2, a refrigerator according to an embodiment and key components constituting the refrigerator will be described in detail.

The refrigerator 1 may have an exterior design defined by a cabinet 2 having one or more storage compartments 110 and 210 as storage spaces for goods; and a plurality of doors 1 and 2 configured to open and close an open front of the cabinet 2.

The cabinet 10 may include an outer case 20 and an inner case coupled inside the outer case 20.

The cabinet 2 may have a box shape with an open front, and may be divided into one or more storages spaces to include a refrigerator compartment and/or a freezer compartment.

The inner case 10 may have a first inner case 100 disposed in an upper area and a second inner case 200 disposed in a lower case.

In this instance, the first inner case 100 may include one or more first storage compartments 110 and the first storage compartment 110 may be refrigerator compartment. The second inner case 200 may include one or more second storage compartments 210 and the second storage compartment 210 may be a freezer compartment.

However, the present disclosure is not limited thereto. The first storage compartment 110 may be a freezer compartment and the second storage compartment 210 may be a refrigerator compartment, and the first and second storage compartments 210 may be convertible type storage compartments that can be freezer and refrigerator compartments.

A display unit 40 may be disposed in an inner upper area of the first storage compartment 110, and may provide an interface so that a user can adjust the temperature of the convertible type storage compartment.

Spaces of the second inner case 200 may be divided by a partition unit 221 vertically extending from an area near the center to partition off the space into a plurality of second storage compartments 210 disposed side by side. However, the present disclosure is not limited thereto.

The plurality of second storage compartments 210 may include a first barrier 231 horizontally extending from the center area to partition off each of the second compartments 210 into a plurality of spaces, but the present disclosure is not limited thereto.

A first storage compartment 110 of the first inner case 100 may be open and closed by a pair of first doors 11 rotatable by a hinge.

The second storage compartment 210 of the second inner case 200 may be open and closed by a plurality of drawer-type second doors 12 withdrawn by a rail.

In the present disclosure, the plurality of second doors 12 may be four doors, and may open and close the second storage compartment 210 including four storage chambers divided by a partition unit 221, a first barrier 231 and a second barrier 232, but the present disclosure is not limited thereto.

The outer case 20 may have a rear surface, a lateral surface, an upper surface and a lower surface formed of separate assembled bodies, respectively, and may define an outer surface of the refrigerator 1 except the front surface.

The first inner case 100 and the second inner case 200 may be disposed to be inserted into the outer case 20, and have a front surface exposed to the outside so as to define a front design of the refrigerator 1.

The first inner case 100 and the second inner case 200 may be independently formed to be separable from each other.

For example, the first inner case 100 and the second inner case 200 may be integrally formed by vacuum forming, but the present disclosure is not limited thereto.

Hereinafter, referring to FIGS. 3 to 9, the second inner case 200 divided into the plurality of storage chambers by including the first carrier 231 and the second barrier 232 will be described in detail.

Also, for description sake, the second inner case 100 is called a storage case 200 and described in detail.

The storage case 200 may include one or more storage chambers 211 and 212.

In the present disclosure, the storage chambers 211 and 212 may mean storage spaces like the storage compartment 210, but the present disclosure is not limited thereto. The storage chambers may mean an outer shape defining the storage compartment 210 like the storage case 200.

For example, the storage case 200 may include a first storage chamber 211 and a second storage chamber 212 that are horizontally disposed side by side by being divided by a partition unit 221 crossing the storage case 200 in a vertical direction.

Specifically, the storage case 200 may be formed to share a boundary surface like the first storage chamber 211 and the second storage chamber 212 share the partition unit 221.

In this instance, the storage case 200 may include the partition unit 221 so that the first storage chamber 211 and the second storage chamber 212 can be integrally formed by the vacuum forming, but the present disclosure is not limited thereto.

For example, the first storage chamber 211 and the second storage chamber 212 may be formed as independent parts, not sharing a separate boundary surface like the partition unit 221.

The first storage chamber 211 and the second storage chamber 212 may be dividedly formed to form independent spaces, respectively.

In the first storage chamber 211, a first barrier 231 crossing the first storage chamber 211 in the vertical direction may be disposed.

The first barrier 231 may extend from a front surface toward a rear surface of the first storage chamber 211 to be in contact with a rear surface 211*b* of the first storage chamber 211.

Specifically, the first barrier 231 may be disposed to contact with both lateral surfaces and the rear surface 211*b* of the first storage chamber 211.

Accordingly, storage space of the first storage chamber 211 may be vertically divided and partitioned into a first upper storage chamber 2111 and a first lower storage chamber 2112.

Accordingly, the first lower storage chamber 2112 may be disposed under the first upper storage chamber 2111, and the first upper storage chamber 2111 and the first lower storage chamber 2112 may be divided into storage spaces that are independent of each other with the first barrier 231 as a boundary surface.

The second storage chamber 212 may be disposed on one side of the first storage chamber 211. Specifically, the first storage chamber 211 and the second storage chamber 212 may be disposed side by side in a horizontal direction.

In the second storage chamber 212, a second barrier 232 may be disposed to across the second storage chamber 212 in the horizontal direction.

The second barrier 232 may extend from a front surface toward a rear surface of the second storage to be spaced apart from a rear surface 212*b* of the second storage chamber 212.

Specifically, the second barrier 232 may be in contact with both lateral surfaces of the second storage chamber 212 but spaced apart from the rear surface 212*b* of the second storage chamber 212.

Accordingly, the second storage chamber 212 may be vertically divided and partitioned into the second upper storage chamber 2121 and the second lower storage chamber 2122, while storage spaces of the second upper storage chamber 2121 and the second lower storage chamber 2122 may be in fluid communication with each other, without being divided.

As a result, the second upper storage chamber 2121 and the second lower storage chamber 2122 may form one storage space, not independent spaces of each other.

However, when viewed in terms of storage space, a second door 12 having drawer-type storage spaces formed separately may be inserted into the second upper storage chamber 2121 and the second lower storage chamber 2122. Accordingly, the second upper storage chamber 2121 and the second lower storage chamber 2122 may be used as separate storage spaces by the second door 12.

The first barrier 231 and the second barrier 232 may be slidingly inserted into the first storage chamber 211 and the second storage chamber 212, respectively, but the present disclosure is not limited thereto.

As described above, the refrigerator 1 according to the present disclosure may include the storage case 200 having the plurality of storage chambers 211 and 212 disposed in the horizontal direction, and also may include the plurality of barriers 231 and 232 crossing the storage chambers 211 and 212, respectively, thereby realizing a four door drawer type storage space.

In addition, the refrigerator 1 according to the present disclosure may be realized to have three independent storage spaces such as the first upper storage chamber 2111, the first lower storage chamber 2112 and the second storage chamber 212, viewed in terms of the independent storage space.

In the rear surface 212*b* of the second storage chamber 212 may be disposed an evaporator 250 configured to generate cold air and a blower fan module 241 configured to blow the cold air generated in the evaporator 250 to each of the storage chambers.

Specifically, one evaporator 250 and one blower fan module 241 may be disposed inside the rear surface 212*b* of the second storage chamber 212.

In the present disclosure, the blower fan module 241 may be shortened to a blower fan.

A grille fan assembly 240 may be disposed on a front surface of the blower fan module 241 to finish an interior design and provide a flow path of cold air.

The cold air generated in the evaporator 250 may be discharged through a plurality of air discharge holes formed in the second storage chamber 212 through the blower fan module 241.

In this instance, a second upper cold air discharge hole 2421 may be disposed in an upper area of the second upper storage chamber 2121, and a second lower cold air discharge hole 2422 may be disposed in a lower area of the second upper storage chamber 2121, so that the cold air generated in the evaporator 250 can be discharged to the second upper storage chamber 2121.

Also, a first upper ice cold air discharge hole 2431 and a second upper ice cold air discharge hole 2432 may be disposed on both sides of the second upper cold air outlet 2421.

Figure 5:
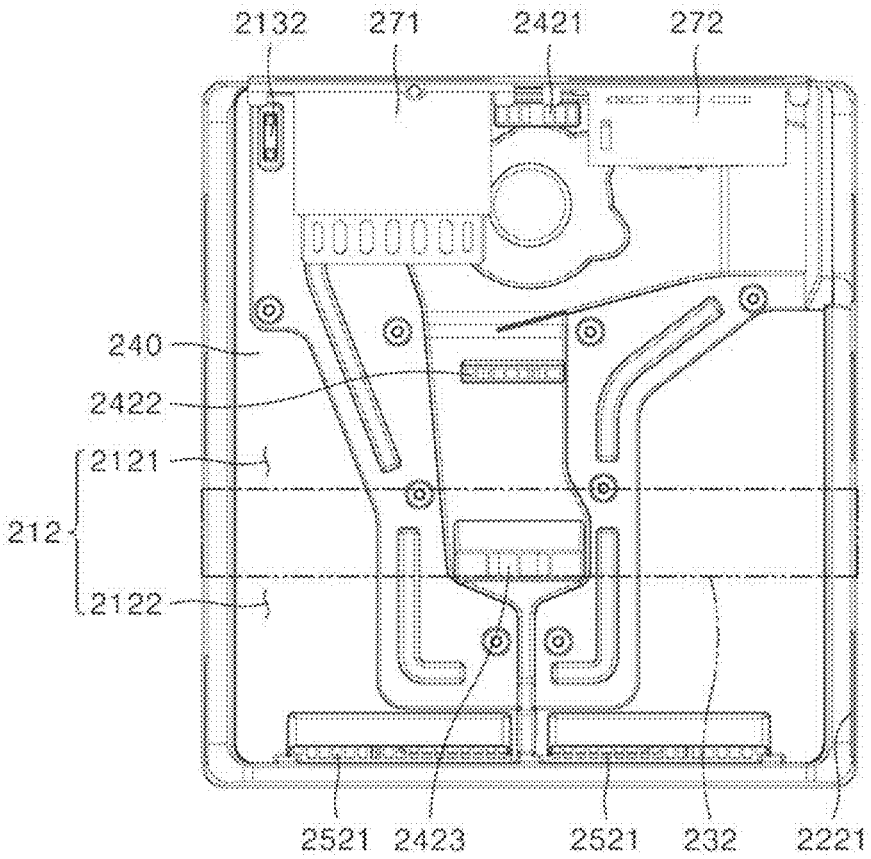
FIG. 5 shows a first ice maker and a second ice maker that are installed in a second storage compartment.
Figure 6:
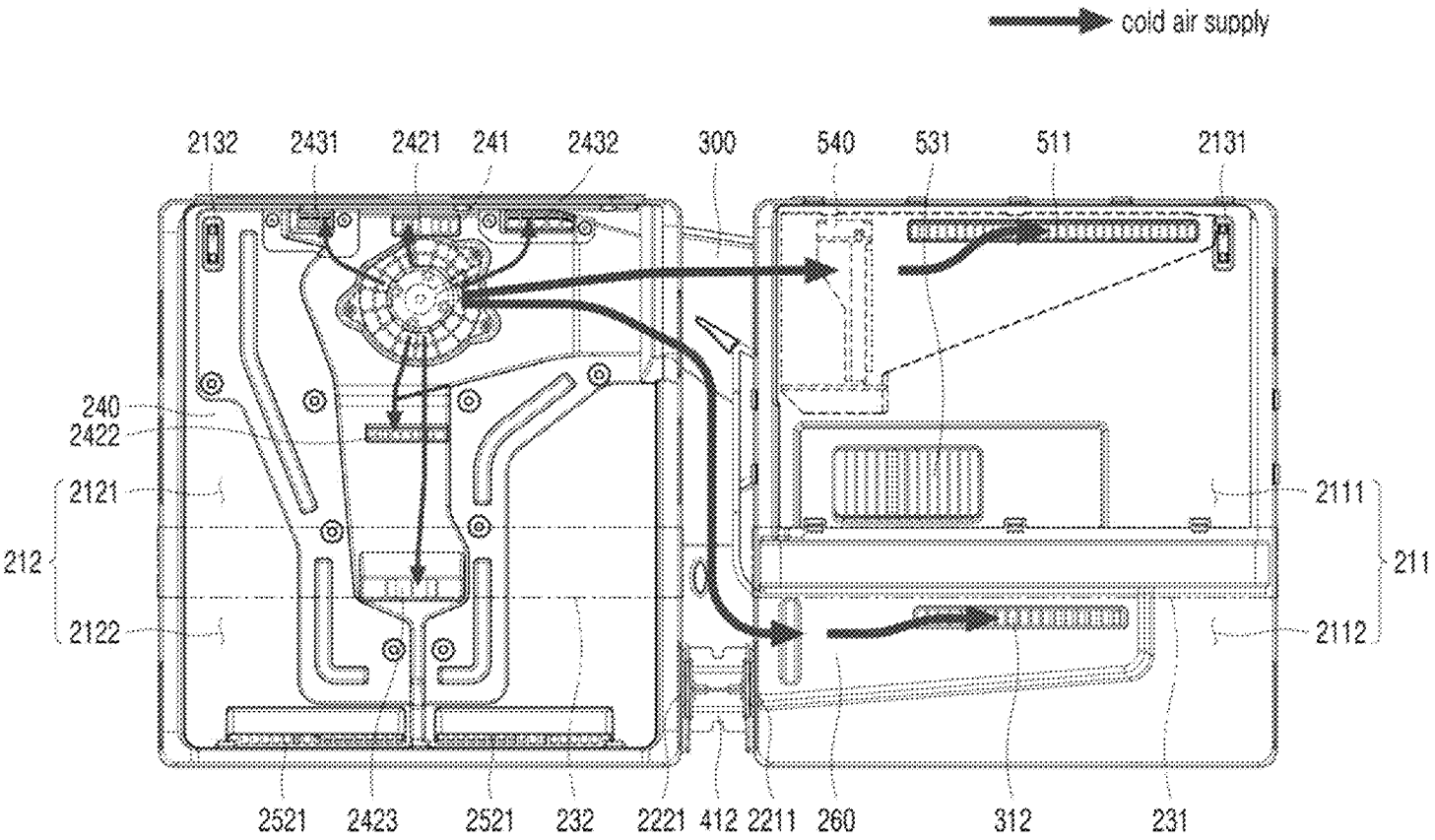
FIG. 6 is a front view showing flow of cold air blown to a first upper storage chamber and a first lower storage chamber by a blower fan disposed in a second storage compartment, respectively.
Figure 7:
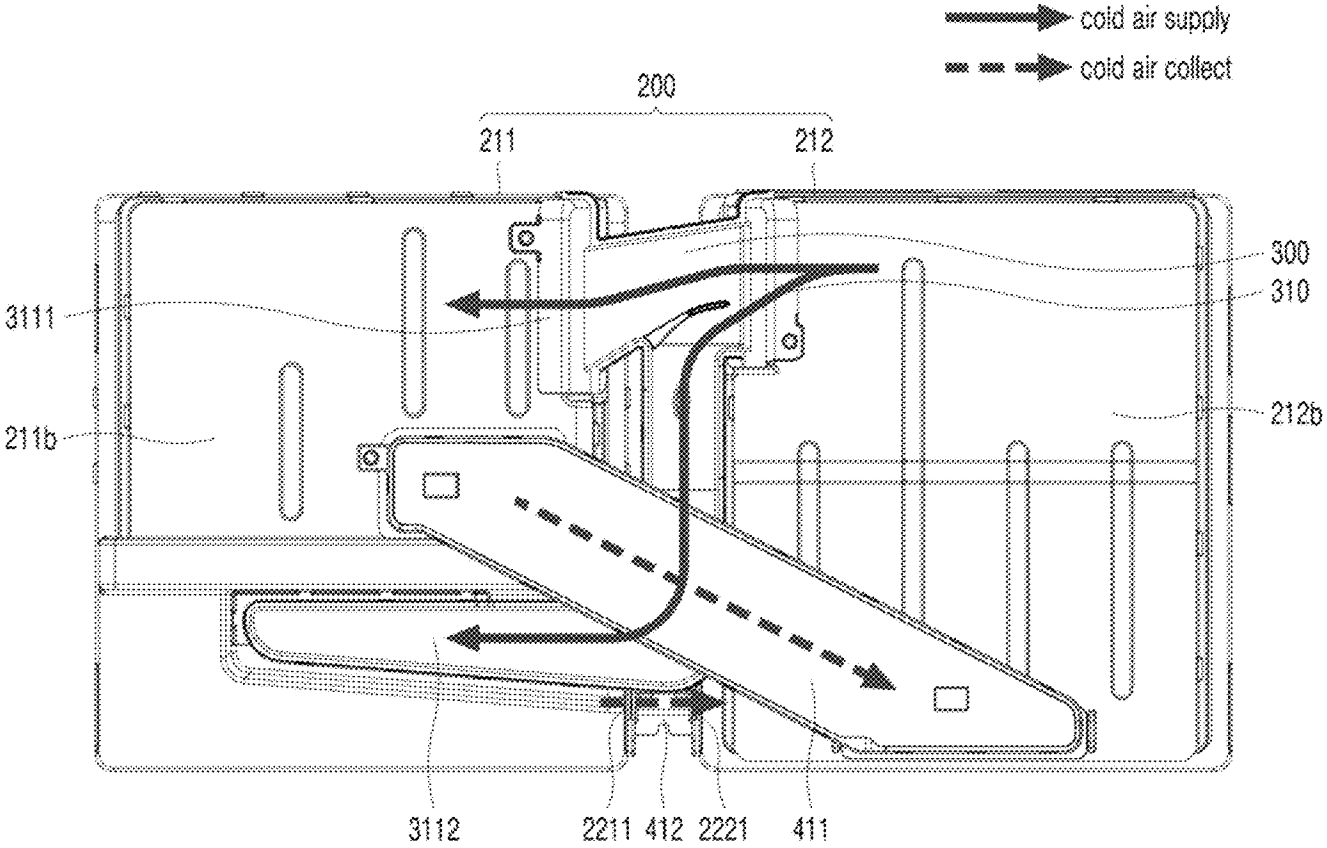
FIG. 7 is a rear view showing a flow path of cold air supplied to a first upper storage chamber and a first lower storage chamber from a second storage compartment, and a flow path of cold air collected in the second storage compartment from the first upper storage chamber and the first lower storage chamber.
Figure 8:
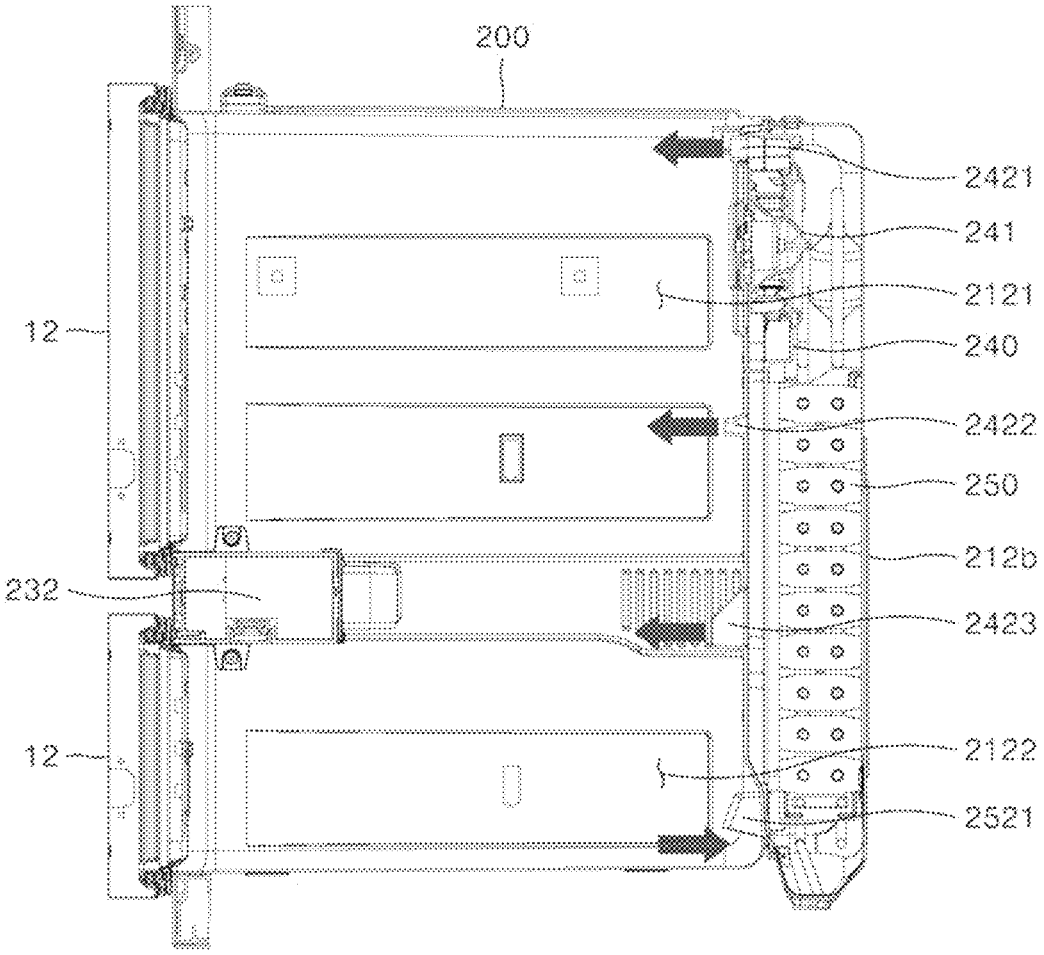
FIG. 8 is a sectional view of a second storage compartment to which a second door is coupled.
Figure 9:
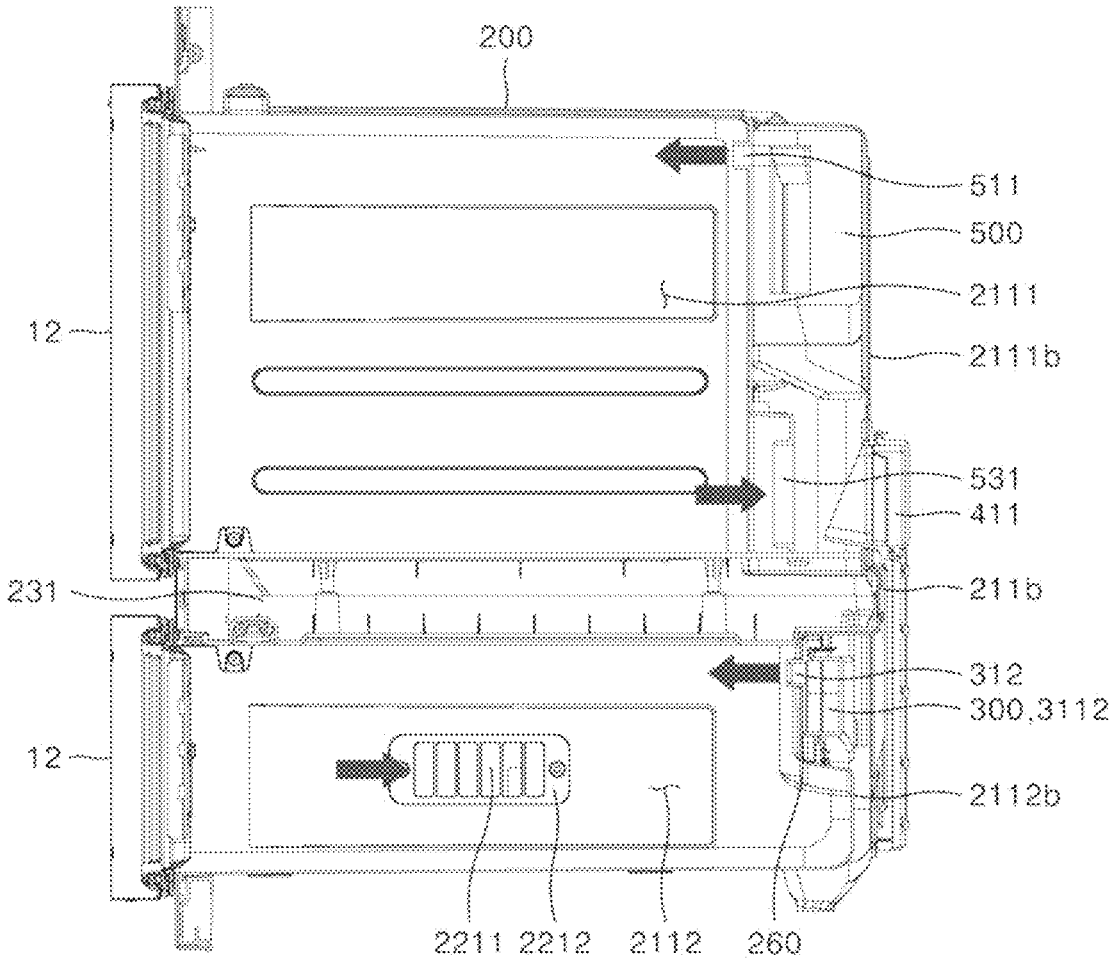
FIG. 9 is a sectional view of a first storage compartment to which a second door is coupled.

Referring to FIG. 5, a first ice maker 271 and a second ice maker 272 may be disposed on a front surface of the first upper ice cold air discharge hole 2431 and a front surface the second upper ice cold air discharge hole 2432, respectively.

The first ice maker 271 and the second ice maker 272 may be configured to supply different types of ice, but the present disclosure is not limited thereto.

The first upper ice cold air discharge hole 2431 and the second upper ice cold air discharge hole 2432 may directly supply cold air to the first ice maker 271 and the second ice maker 272, so that ice may be made in each of the ice makers.

The cold air discharged through the second upper cold air discharge hole 2421 disposed between the first upper ice cold air discharge hole 2431 and the second upper ice cold air discharge hole 2432 may pass between the first ice maker 271 and the second ice maker 272 and flow forward.

When the second door 12 is open, external air that is relatively humid may flow into the second storage chamber 212 from the outside. Frost may be formed in the first ice maker 271 and the second ice maker 272 by the external air introduced in this way.

In this instance, the cold air discharged through the second upper cold air discharge hole 2421 may remove the frost, while passing between the first icemaker 271 and the second icemaker 272. Accordingly, the second upper cold air discharge hole 2421 may not only supply cold air to the second storage chamber 212 but also prevent frost.

The first upper cold air discharge hole 2421, the second upper ice cold air discharge hole 2431 and the second upper ice cold air discharge hole 2432 may be disposed higher than the blower fan module 241. The lower cold air discharge hole 2422 may be disposed lower than the blower fan module 241.

A 2-3 cold air discharge hole 2423 may be disposed in an upper area of the second lower storage chamber 2122 so that the cold air generated in the evaporator 250 may be discharged to the second lower storage chamber 2122.

In this instance, the 2-3 cold air discharge hole 2423 may overlap with the second barrier 232 disposed on the front surface in a front-rear direction.

A second lower cold air collecting hole 2521 may be disposed in a lower area of the second lower storage chamber 2122 to collect the cold air discharged to the second storage chamber 212.

As described above, the second barrier 232 may be spaced apart from the rear surface 212*b* of the second storage chamber to facilitate communication between the second upper storage chamber 2121 and the second lower storage chamber 2122. Accordingly, the cold air circulating through the second upper storage chamber 2121 and the second lower storage chamber 2122 may be shared with each other.

Accordingly, since the cold air discharged through the second upper cold air outlet 2421, the second lower cold air discharge hole 2422 and the 2-3 cold air discharge hole 2423 is collected through the second lower cold air collecting hole 2521 disposed in the lower area, the cold air may be uniformly circulated inside the second upper storage chamber 2121 and the second lower storage chamber 2122.

In other words, the cold air flowing inside the second upper storage chamber 2121 and the second lower storage chamber 2122 may be discharged through the same cold air discharge hole and collected through the same cold air collecting hole.

Accordingly, the second upper storage chamber 2121 and the second lower storage chamber 2122 may be controlled at the same temperature. The second upper storage chamber 2121 and the second lower storage chamber 2122 may be used as the freezer compartment.

Meanwhile, the cold air generated in the evaporator 250 disposed on the rear surface 212*b* of the second storage chamber 212 may be blown by the blower fan module 241 and then supplied to the first storage chamber 211 through a cold air supply duct 300.

The cold air blown from the second storage chamber 212 may be supplied to the first upper storage chamber 2111 and the first lower storage chamber 2112 by one cold air supply duct 300 branched to have two independent cold air supply paths to distribute cold air to the first upper storage chamber 2111 and the first lower storage chamber 2112.

A cold air inlet 210 may be formed on one side of the cold air supply duct 300 and may be in fluid communication with an upper area of the second storage chamber 212.

A first upper cold air outlet 3111 may be formed on the other side of the cold air supply duct 300 and may be in fluid communication with an upper area of the first storage chamber 211 facing the upper area of the second storage chamber 212.

Accordingly, the first upper cold air outlet 3111 may be in fluid communication with the first upper storage chamber 2111.

A first upper duct assembly 500 including a first upper cold air discharge hole 511 may be disposed in an upper area of the first upper storage chamber 2111, and may be in fluid communication with the first upper cold air outlet 3111 of the cold air supply duct 300.

Accordingly, the cold air generated in the evaporator 250 may pass through the first upper cold air outlet 3111 of the cold air supply duct 300 and a first upper duct assembly 500, and may be discharged to the first upper storage chamber 2111 through the first upper air discharge hole 511.

The first upper cold air collecting hole 531 may be disposed in the lower area of the first upper storage chamber 2111 to collect the cold air having circulated the first upper storage chamber 2111.

The cold air collected through the first upper cold air collecting hole 531 may be re-supplied to the evaporator 250 through a first upper cold air collecting duct 411 disposed on a rear surface of the storage case 200, while being in fluid communication with the first upper cold air collecting hole 531.

Accordingly, one side of the first upper cold air collecting duct 411 may be in fluid communication with the rear surface of the first upper storage chamber 2111, and the other side thereof may be in fluid communication with the rear surface of the second storage chamber 212.

A first lower cold air outlet 3112 of the cold air supply duct 300 may be formed on the rear surface of the first lower storage chamber 2112 to supply cold air to the first lower storage chamber 2112.

Specifically, a predetermined area of the cold air duct 300 including the first lower cold air discharge hole 312 may be disposed to overlap with the rear surface 2112*b* of the first lower storage chamber 2112.

The first lower cold air outlet 3112 may be disposed below the first upper cold air outlet 3111, and may be bent to extend along a horizontal direction of the rear surface of the first lower storage chamber 2112.

Since the first lower cold air outlet 3112 is disposed outside the rear surface of the first lower storage chamber 2112, a protrusion 260 protruded forward with a shape corresponding to the first lower cold air outlet 3112 may be formed in the first lower storage chamber 2112.

Accordingly, the first lower cold air outlet 3112 may be seated on a rear surface of the protrusion 260 of the first lower storage chamber 2112.

A first lower cold air discharge hole 312 may be formed in the first lower cold air outlet 3112, and the first lower cold air discharge hole 312 may be disposed in an upper area of the first lower storage chamber 2112.

Then, the cold air generated in the evaporator 250 may pass through the first lower cold air outlet 3112 of the cold air supply duct 300, and may be discharged to the first lower storage chamber 2112 through the first lower cold air discharge hole 312.

However, the present disclosure describes that the first lower cold air outlet 3112 includes the first lower cold air discharge hole 312, but the present disclosure is not limited thereto. the present disclosure may describe that the first lower cold air outlet 3112 is equal to the first lower cold air discharge hole 312.

A first cold air collecting communication hole 2211 may penetrate one side of the lower area of the first storage chamber 211, and a second cold air collecting communication hole 2221 may penetrate one side of the lower area of the second storage chamber 212. Here, the sides may face each other.

Accordingly, the first cold air collecting communication hole 2211 and the second cold air collecting communication hole 2221 may be disposed to face each other.

A first lower cold air collecting duct 412 for facilitating communication between the first lower storage chamber 2112 and the second lower storage chamber 2122 may be disposed between the first cold air collecting communication hole 2211 and the second cold air collecting communication hole 2221.

For example, a communication hole cover 2212 including a plurality of ribs may be disposed in the first cold air collecting communication hole 2211.

The cold air discharged to the first upper storage chamber 2111 through the first upper cold air discharge hole 511 may be collected in the second storage chamber 212 through the first cold air collecting communication hole 2211 and the second cold air collecting communication hole 2221 that are in communication by the first lower cold air collecting duct 412.

The cold air collected in the second storage chamber 212 may be collected in the evaporator 250 by the second lower cold air collecting hole 2521 again.

As described above, the cold air circulating the first upper storage chamber 2111 and the first lower storage chamber 2112 may be discharged through the different cold air discharge holes, and may be collected through the different cold air collecting holes.

Accordingly, the first upper storage chamber 2111 and the first lower storage chamber 2112 may be controlled at different temperatures.

Since the first lower storage chamber 2112, the second upper storage chamber 2121 and the second lower storage chamber 2122 share the circulating cold air, they may be controlled at the same temperature. The first lower storage chamber 2112, the second upper storage chamber 2121 and the second lower storage chamber 2122 may be used as the freezer compartments.

However, the meaning of being controlled at the same temperature as meant in the present disclosure does not mean that the temperatures in all areas are completely the same.

For example, although the temperature of the cold air in the corresponding storage chambers may be substantially the same as the circulation cycle of the cold air is shared without blocking each other. However, the temperature may be slightly different for each area based on the flow rate or velocity of the supplied cold air.

The first upper storage chamber 2111 may not share the cold air circulation cycle with other storage chambers.

In this instance, the first upper storage chamber 2111 may be used as the freezer compartment but it may be used as the refrigerator compartment.

The first upper storage chamber 2111 may be used as a convertible storage chamber of which purpose is changed to the freezer compartment or the refrigerator compartment based on a user's selection.

To this end, a first upper flow path opening/closing damper 540 may be disposed in the first upper duct assembly 500 to selectively block cold air so as to adjust the amount of the supplied cold air.

The opening and closing of the first upper flow path opening/closing damper 540 may be controlled by a control unit so that the refrigerator compartment and the freezer compartment may be freely convertible based on the user's selection.

A first sensor unit 2131 may be disposed on one side of an upper area of the first upper storage chamber 2111 to detect the temperature of the corresponding storage chamber. A second sensor unit 2132 may be disposed on one side of an upper area of the second storage chamber 212 to detect the temperature of the corresponding storage chamber.

As described above, the refrigerator 1 according to the present disclosure may independently control the temperatures of the plurality of storage chambers by allowing cold air circulating through the plurality of storage chambers partitioned off by the barriers to be discharged and collected through the different cold air discharge holes the cold air collecting holes.

Accordingly, there is an advantage in that a specific storage compartment may be freely convertible into the freezer compartment or the refrigerator compartment based on the user's choice.

The refrigerator 1 according to the present disclosure may include one cold air supply duct 300 branched to have two independent cold air supply paths, so that cold air may be supplied to the two independent storage chambers 2111 and 2112 through only one cold air supply duct 300.

In addition, the refrigerator 1 according to the present disclosure may include one cold air supply duct 300 branched to have two independent cold air supply paths, so that three independent storage chamber 2111, 2112 and 212 may be cooled through one evaporator 250 and one blower fan 241 disposed in one storage chamber.

The refrigerator 1 according to the present disclosure may cool the three independent storage chambers 2111, 2112 and 212 through one evaporator 250 and one blower fan 241 disposed in one storage chamber 212. Due to this structure, the inner volume of the storage chambers 2111 and 2112 in which the evaporator 250 and the blower fan 241 are not disposed may be increased.

Since the refrigerator 1 according to the present disclosure may cool the three independent storage chambers 2111, 2112 and 212 only through one evaporator 250 and one blower fan 241 disposed in one storage chamber 212, the power consumption and noise, which might occur due to the addition of the evaporator 250 and the blower fan 241 may be reduced.

In addition, since the refrigerator 1 according to the present disclosure may cool the three independent storage chambers 2111, 2112 and 212 only by including one cold air supply duct 300 configured to supply cold air to two independent storage chambers 2111 and 2112, the decrease in component costs may be minimized.

Figure 10:
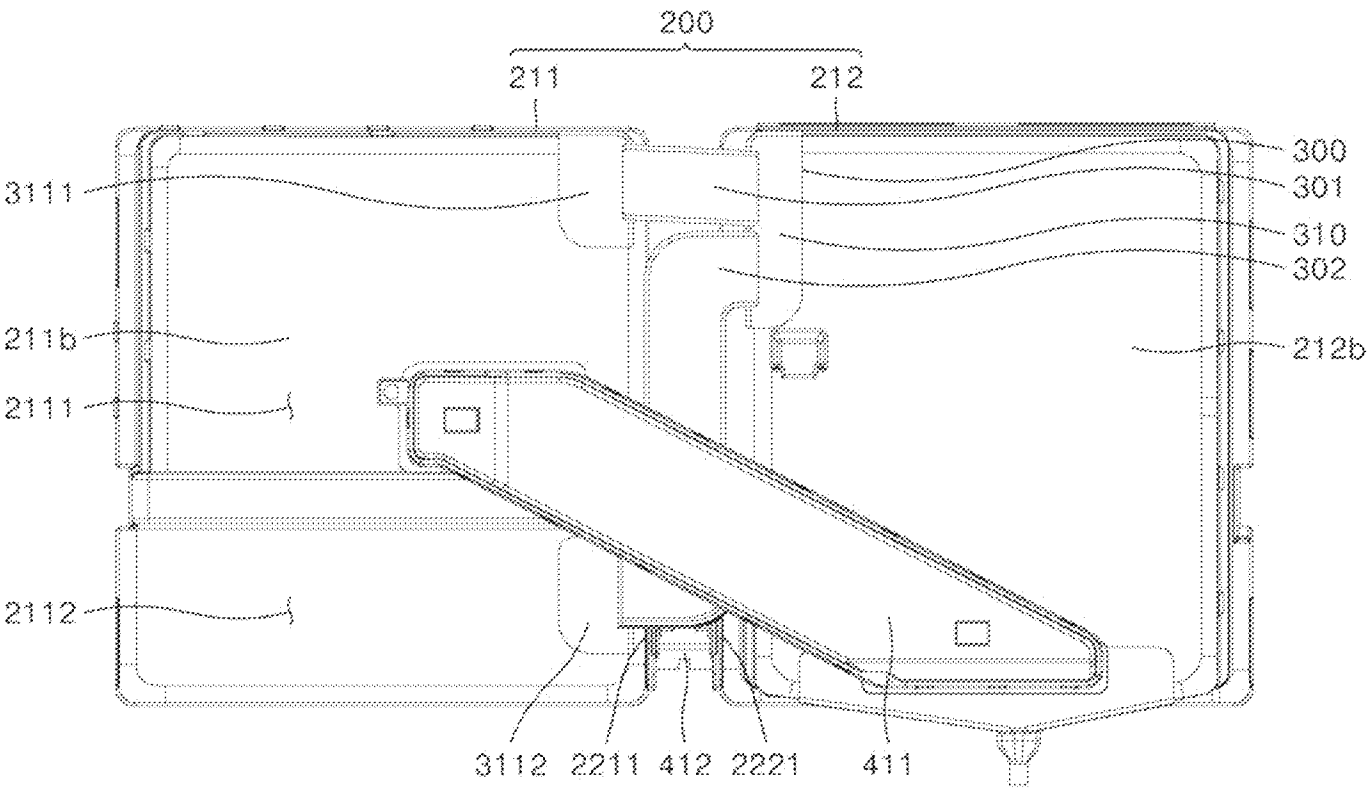
FIG. 10 is a rear view showing a cold air supply duct and a cold air collecting duct, which connect a first storage compartment and a second storage compartment with each other, according to another embodiment.

Hereinafter, referring to FIGS. 10 to 12, a cold air supply duct 300 according to another embodiment of the present disclosure and an inner structure of a first storage chamber 211 will be additionally described, and differences from the above description will be mainly explained.

The cold air supply duct 300 may include a cold air inlet 310 in fluid communication with one lateral surface of a second storage chamber 212; a first upper cold air outlet 3111 in fluid communication with one lateral surface of the first upper storage chamber 2111; and a first lower cold air outlet 3112 in fluid communication with one lateral surface of the first lower storage 2112.

A flow path of the cold air from the cold air inlet 310 to the first upper cold air outlet 3111 may be a first cold air supply path 301. A flow path from the cold air inlet 310 to the first lower cold air outlet 3112 may be a second cold air supply path 302.

In this instance, the first cold air supply path 301 and the second cold air supply path 302 may be branched at the cold air inlet 310, and may have a separate shape so that the separation of the paths may be visibly checked from the outside. However, the present disclosure is not limited thereto.

Since the first lower cold air outlet 3112 is in fluid communication with one lateral surface of the first lower storage chamber 2112, a separate duct assembly and a separate cold air discharge hole, which are capable of discharging cold air to the first lower storage chamber 2112, could be required unlike the embodiment of the cold air supply duct 300 described above.

Figure 11:
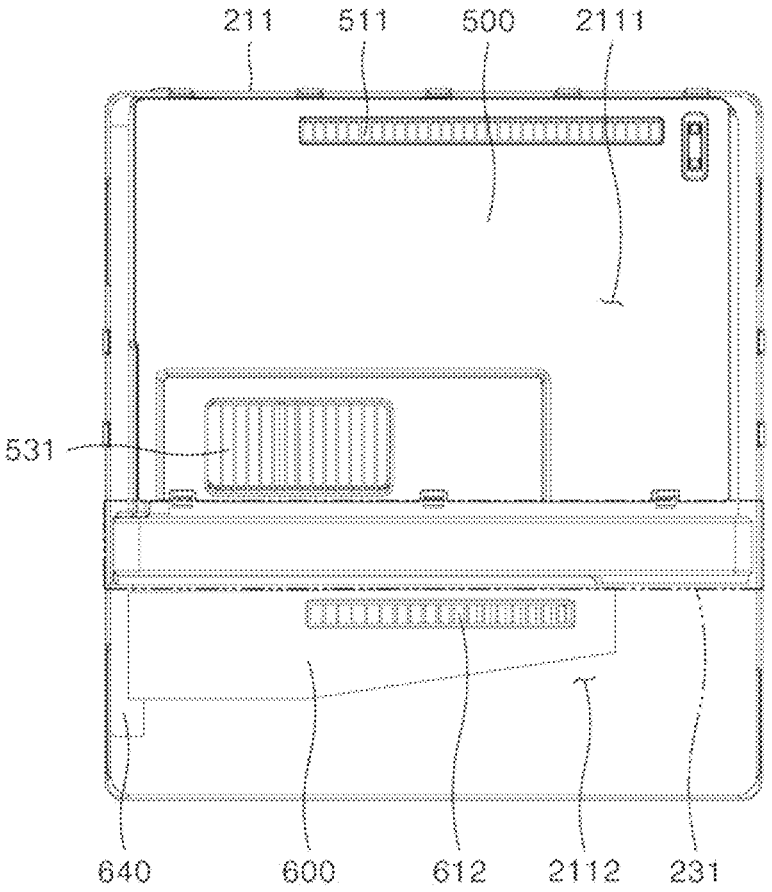
FIG. 11 is a front view showing an inside of a first storage compartment according to a further embodiment.

Therefore, referring to FIG. 11, in the first lower storage chamber 2112 may be disposed a first lower flow path opening/closing damper 640 and a first lower duct assembly 600 including a first lower cold air discharge hole 612 to be in fluid communication with the cold air supply duct 300.

Accordingly, the cold air flowing to the first lower cold air outlet 3112 through the second cold air supply path 301 may be discharged into the first lower storage chamber 2112 through the first lower cold air discharge hole 612.

As described above, the first lower flow path opening/closing damper 640 may be disposed in the first lower storage chamber 2112, to independently control the temperature. Due to the structure, the first lower storage chamber 2112 may be used as the refrigerator compartment as well as the freezer compartment.

In addition, the first lower storage chamber 2112 may be used as a convertible storage compartment that is convertible into a refrigerator compartment or a freezer compartment.

Figure 12:
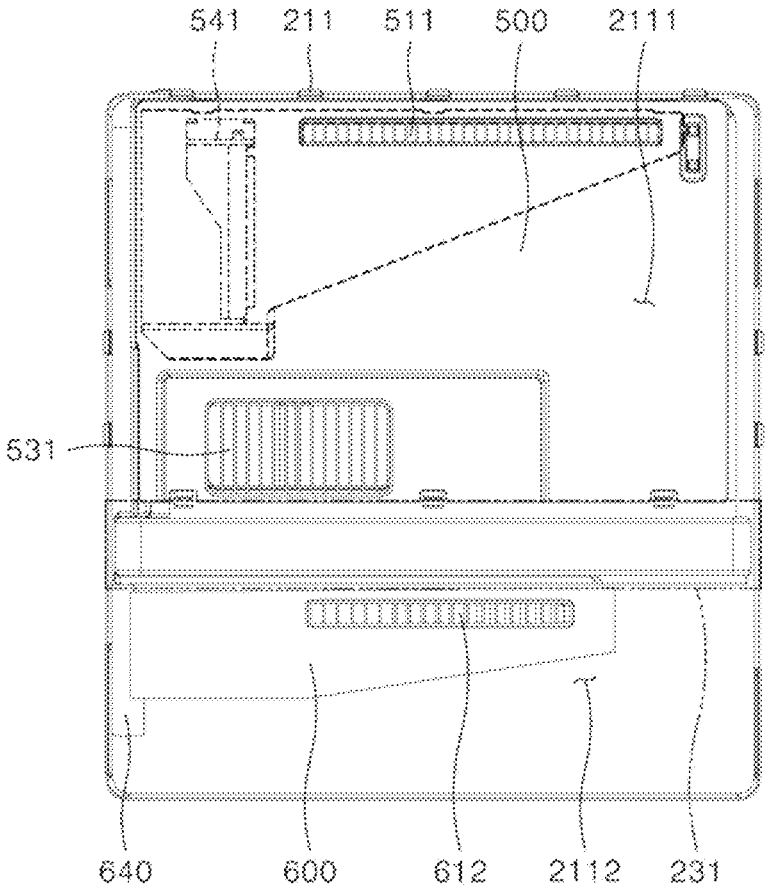
FIG. 12 is a front view showing an inside of a first storage compartment according to a still further embodiment.

Referring to FIG. 12, a first upper duct assembly 500 including a first upper flow path opening/closing damper 540 selectively blocking the cold air supplied from the cold air supply duct 300 and a second lower duct assembly 600 including a first lower flow path opening/closing damper 640 selectively blocking the cold air supplied from the cold air supply duct 300 may be disposed in the first upper storage chamber 2111 and the first lower storage 1221, respectively.

Accordingly, both the first upper storage chamber 2111 and the first lower storage chamber 2112 may control its temperatures independently of the second storage chamber 212, so that they may be used as the refrigerator compartments as well as the freezer compartments.

Both the first upper storage chamber 2111 and the first lower storage chamber 2112 may be used as convertible storage compartments that may be convertible to the freezer compartment and the refrigerator compartment.

Figure 13:
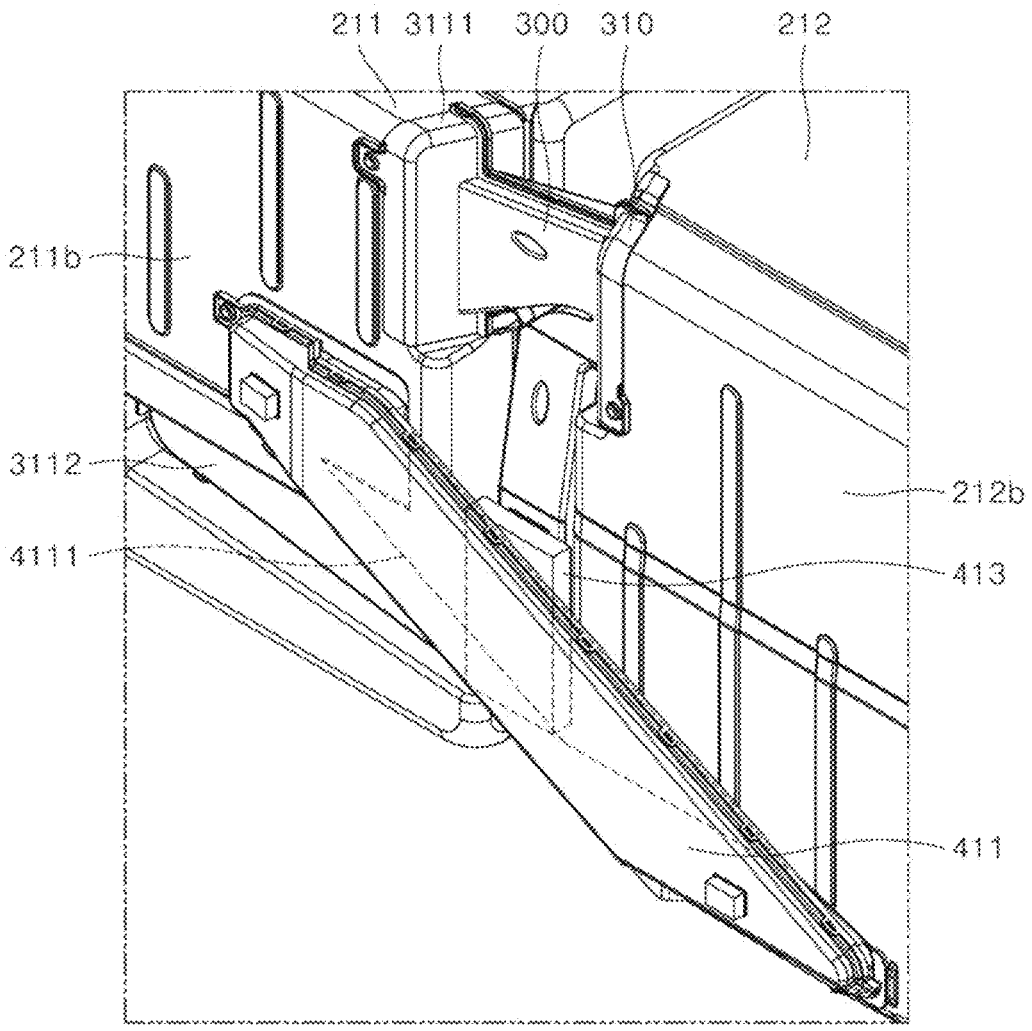
FIGS. 13 and 14 are rear views showing an arrangement structure of a first upper cold air collecting duct and a cold air supply duct that are disposed to cross each other with a heat generation part and a heat insulating member interposed therebetween.
Figure 14:
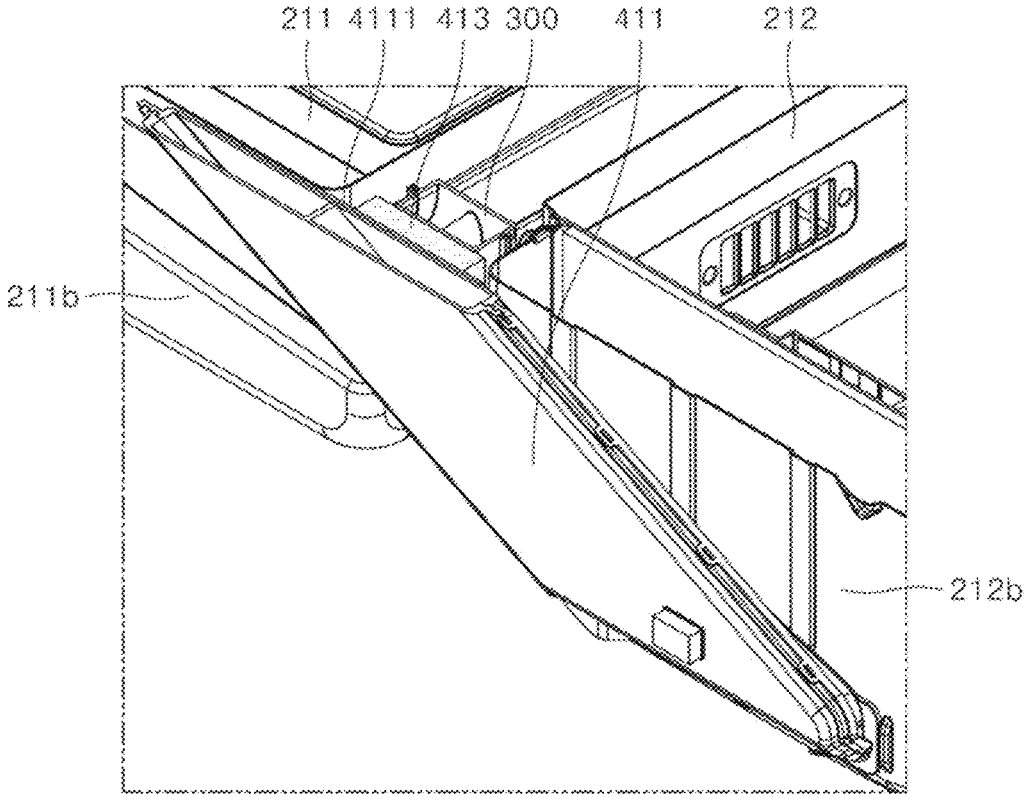

FIG. 13 is rear views showing an arrangement structure of a first upper cold air collecting duct 411 and a cold air supply duct 300 that are disposed to cross each other, and FIG. 14 is a sectional view cut away along a horizontal direction in a crossing area.

The first upper cold air collecting duct 411 collecting cold air of the first upper storage chamber 2111 in the second storage chamber 212 may be disposed behind the cold air supply duct 300 supplying cold air from the second storage chamber 212 to the first upper storage chamber 2111 and the first lower storage chamber 2112.

Specifically, since the first upper cold air collecting duct 411 facilitates the communication between the first upper storage chamber 2111 positioned at a left upper end with respect to the rear surface and a lower area of the second storage chamber 212 positioned at a right end of the first upper storage chamber 2111, it may have a duct shape longitudinally extending in a diagonal direction.

Accordingly, the first upper cold air collecting duct 411 may be formed to cross the cold air supply duct 300 disposed in front.

As described above, due to the efficiency arrangement structure that the first upper cold air collecting duct 411 and the cold air supply duct 300 are disposed to cross each other, the utilization of space in a small space.

Meanwhile, since the cold air passing through the first upper cold air collecting duct 411 is the cold air to be collected in the evaporator 250, it may be relatively high temperature high humidity cold air, compared to the cold air passing through the cold air supply duct 300 after blown from the evaporator 250.

In this way, due to the temperature and humidity difference between the cold air passing through the first upper cold air collecting duct 411 and the cold air supply duct 300, respectively, wet stem could occur and icing or frost could occur in the crossing area of the first upper cold air collecting duct 411 and the cold air supply duct 300 due to the wet steam.

In this instance, there is a high possibility that icing occurs inside the flow path of the first upper cold air collecting duct 411. When icing occurs inside the flow path of the first upper cold air collecting duct 411, the cold air collecting could not be performed smoothly and the overall cold air supply system could not be operated appropriately.

Accordingly, a heating unit 4111 may be disposed in the cross area between the first upper cold air collecting duct 411 and the cold air supply duct 300.

For example, the heating unit 4111 may be formed along one lateral surface of the first upper cold air collecting duct 411 facing the cold air supply duct 300.

The cold air collected through the first upper cold air collecting duct 411 relatively high temperature and high humidity air, compared not only to the cold air passing through the cold air supply duct 300 as well as the cold air inside the first storage chamber 211 and the second storage chamber 212 provided in front of the first upper cold air collecting duct 411.

Accordingly, by forming the heating unit 411 along one lateral surface of the first upper cold air collecting duct 411 in the area large as possible, it is possible to reduce occurrence of icing not only in the crossing area between the first upper cold air collecting duct 411 and the cold air supply duct 300 but also in on entire lateral surface of the first upper cold air collecting duct 411.

For example, the heating unit 4111 may be formed on the entire lateral surface of the first upper cold air collecting duct 411 facing the first storage chamber 211 and the second storage chamber 212, except one end of the first upper cold air collecting duct 411 in fluid communication with the rear surface 211*b* of the first storage chamber and the other end of the first upper cold air collecting duct 411.

However, the present disclosure is not limited thereto, and the heating unit 4111 may be formed only in a predetermined area including the crossing area between the first upper cold air collecting duct 411 and the cold air supply duct 300.

The heating unit 4111 may have the same shape as a heating wire, and may supply heat to the heating wire under the control of the controller provided in the refrigerator 1.

Meanwhile, since a greater difference in temperature and humidity could occur in the crossing area between the first upper cold air collecting duct 411 and the cold air supply duct 300, an insulation material 413 may be further disposed.

For example, the insulation member 413 may be a vacuum insulating material with a predetermined thickness, but the present disclosure is not limited thereto.

The insulating member 413 may be disposed in the crossing area between the first upper cold air collecting duct 411 and the cold air supply duct 300.

Accordingly, since the heating unit 4111 and the insulation material 413 overlap with each other in the crossing area between the first upper cold air collecting duct 411 and the cold air supply duct 300, icing phenomenon caused by wet steam, which might occur in the crossing area, can be effectively reduced.

The embodiments are described above with reference to a number of illustrative embodiments thereof. However, the present disclosure is not intended to limit the embodiments and drawings set forth herein, and numerous other modifications and embodiments can be devised by one skilled in the art. Further, the effects and predictable effects based on the configurations in the disclosure are to be included within the range of the disclosure though not explicitly described in the description of the embodiments.

What is claimed is:

1. A refrigerator comprising:

a storage case having:

a first storage chamber, the first storage chamber including:

a first upper storage chamber; and a first lower storage chamber; and a second storage chamber, the second storage chamber including:

a second upper storage chamber; and a second lower storage chamber, the second upper storage chamber and the second lower storage chamber being in fluid communication with each other, a grille fan assembly located in the second storage chamber, the grille fan assembly including:

an evaporator;

a blower fan configured to blow cold air generated from the evaporator to the first upper storage chamber and the first lower storage chamber;

a cold air supply duct configured to supply cold air to the first upper storage chamber and the first lower storage chamber;

a first flow path damper configured to block cold air blown by the blower fan; and a controller configured to control the first flow path damper, wherein the first flow path damper is located at the first storage chamber, and wherein at least one of the first upper storage chamber and the first lower storage chamber is a convertible storage compartment that is controllable by the controller to operate as a freezer compartment or a refrigerator compartment.

2. The refrigerator of claim 1, further comprising:

a first barrier dividing the first storage chamber into the first upper storage chamber and the first lower storage chamber; and a second barrier dividing the second storage chamber into the second upper storage chamber and the second lower storage chamber, the second barrier being configured to allow the second upper storage chamber and the second lower storage chamber to be in fluid communication with each other.

3. The refrigerator of claim 1, further comprising:

an upper cold air collecting duct extending from the first upper storage chamber to the second storage chamber to supply cold air from the first upper storage chamber to the second storage chamber; and a lower cold air collecting duct extending from the first lower storage chamber to the second storage chamber to supply cold air from the first lower storage chamber to the second storage chamber, wherein the upper cold air collecting duct crosses the cold air supply duct.

4. The refrigerator of claim 3, further comprising a heater on one surface of the upper cold air collecting duct facing the cold air supply duct.

5. The refrigerator of claim 3, further comprising an insulation material between the upper cold air collecting duct and the cold air supply duct, the insulation material being located between the upper cold air collecting duct and the cold air supply duct in an area where the upper cold air collecting duct crosses the cold air supply duct.

6. The refrigerator of claim 3, wherein the cold air supply duct comprises:

a cold air inlet in fluid communication with the second storage chamber;

an upper cold air outlet in fluid communication with the first upper storage chamber; and a lower cold air outlet in fluid communication with the first lower storage chamber.

7. The refrigerator of claim 3, wherein the first flow path damper is located at the first upper storage chamber, and wherein the first upper storage chamber is controlled to be at a different temperature from a temperature of the first lower storage chamber and the second storage chamber.

8. The refrigerator of claim 7, wherein the first upper storage chamber is the convertible storage compartment, and wherein the first lower storage chamber and the second storage chamber are freezer compartments.

9. The refrigerator of claim 3, wherein the first flow path damper is located at the first lower storage chamber, and wherein the first lower storage chamber is controlled to be at a temperature different from a temperature of the first upper storage chamber and the second storage chamber.

10. The refrigerator of claim 9, wherein the first lower storage chamber is the convertible storage compartment, and wherein the first upper storage chamber and the second storage chamber are freezer compartments.

11. The refrigerator of claim 3, further comprising a second flow path damper configured to selectively block cold air supplied from the cold air supply duct, the second flow path damper being located at the first lower storage chamber, wherein the first flow path damper is located at the first upper storage chamber, and wherein the first upper storage chamber and the first lower storage chamber are controlled to be at a temperature different from a temperature of the second storage chamber.

12. The refrigerator of claim 11, wherein both the first upper storage chamber and the first lower storage chamber are convertible storage compartments, and wherein the second storage chamber is a freezer compartment.

13. The refrigerator of claim 1, further comprising:

a first ice maker located at a first side of the blower fan in the second upper storage chamber; and a second ice maker located at a second side of the blower fan in the second upper storage chamber.

* * * * *